US006642834B1

(12) United States Patent
Oh et al.

(10) Patent No.: US 6,642,834 B1
(45) Date of Patent: Nov. 4, 2003

(54) HIGH VOLTAGE AUTOMOTIVE USE

(75) Inventors: Seibang Oh, Elk Grove Village, IL (US); James Jie Chen, Palatine, IL (US)

(73) Assignee: Littelfuse, Inc., Des Plaines, IL (US)

( * ) Notice: Subject to any disclaimer, the term of this patent is extended or adjusted under 35 U.S.C. 154(b) by 0 days.

(21) Appl. No.: 09/516,574

(22) Filed: Mar. 1, 2000

Related U.S. Application Data

(60) Provisional application No. 60/123,078, filed on Mar. 4, 1999.

(51) Int. Cl.[7] ..... H01H 85/38; H01H 85/08

(52) U.S. Cl. ..... 337/282; 337/273; 337/295

(58) Field of Search ..... 337/260, 273, 337/274, 275, 282, 290, 295; 29/623

(56) References Cited

U.S. PATENT DOCUMENTS

| | | | | | |
|---|---|---|---|---|---|
| 480,802 | A | * | 8/1892 | Blathy | 337/278 |
| 1,700,582 | A | * | 1/1929 | Brown | 337/216 |
| 2,245,346 | A | * | 6/1941 | Klein | 200/131 |
| 2,794,097 | A | * | 5/1957 | Jacobs, Jr. | 337/278 |
| 3,775,723 | A | * | 11/1973 | Mamrick et al. | 337/245 |
| 3,909,767 | A | | 9/1975 | Williamson et al. | |
| 4,023,265 | A | | 5/1977 | Aryamane | |
| 4,071,837 | A | * | 1/1978 | Ranzanigo | 337/268 |
| 4,131,869 | A | | 12/1978 | Schmidt, Jr. et al. | |
| 4,224,592 | A | * | 9/1980 | Urani et al. | 337/198 |
| 4,544,907 | A | * | 10/1985 | Takano | 337/262 |
| 4,570,147 | A | * | 2/1986 | Ebi | 337/166 |
| 4,580,124 | A | | 4/1986 | Borzoni | |
| 4,604,602 | A | | 8/1986 | Borzoni | |
| 4,608,548 | A | * | 8/1986 | Borzoni | 337/201 |
| 4,635,023 | A | | 1/1987 | Oh | |
| 4,646,053 | A | * | 2/1987 | Mosesian | 337/232 |
| 4,661,793 | A | | 4/1987 | Borzoni | |
| 4,672,352 | A | * | 6/1987 | Takano | 337/264 |
| 4,703,299 | A | * | 10/1987 | Vermij | 337/158 |
| 4,869,972 | A | * | 9/1989 | Hatagishi | 428/647 |
| 4,871,990 | A | * | 10/1989 | Ikeda et al. | 337/238 |
| 4,894,633 | A | | 1/1990 | Holtfreter | |
| 4,997,393 | A | | 3/1991 | Armando | |
| 4,998,086 | A | * | 3/1991 | Kourinsky et al. | 337/255 |
| 5,101,187 | A | * | 3/1992 | Yuza | 337/278 |
| 5,130,688 | A | * | 7/1992 | Van Rietschoten et al. | 337/231 |
| 5,139,443 | A | | 8/1992 | Armando | |
| 5,153,553 | A | * | 10/1992 | Ruehl et al. | 337/273 |
| 5,581,225 | A | * | 12/1996 | Oh et al. | 337/295 |
| 5,631,620 | A | * | 5/1997 | Totsuka et al. | 337/245 |
| 5,663,861 | A | | 9/1997 | Reddy et al. | |
| 5,668,521 | A | | 9/1997 | Oh | |
| 6,496,096 | B2 | * | 12/2002 | Kondo et al. | 337/234 |

FOREIGN PATENT DOCUMENTS

| | | | | |
|---|---|---|---|---|
| DE | 27 14 797 A1 | | 2/1979 | |
| EP | 0 285 489 A1 | | 10/1988 | |
| EP | 0 802 553 A2 | | 10/1997 | |
| EP | 0 939 417 A1 | | 9/1999 | |
| GB | 2 113 489 A | | 8/1983 | |
| GB | 2 233 512 A | | 1/1991 | |
| JP | 6-48149 U | * | 6/1994 | H01H/85/0445 |
| JP | 10-241546 A | * | 9/1998 | H01H/85/18 |

* cited by examiner

*Primary Examiner*—Anatoly Vortman
(74) *Attorney, Agent, or Firm*—Bell, Boyd & Lloyd LLC

(57) ABSTRACT

The invention is a blade fuse having a housing section and a fusible element. The housing includes an insulating portion or tab extending from the housing section, and disposed between opposite ends of the fusible element. One aspect of the invention is a blade fuse where the insulating tab is integral with the housing. The insulating tab may be integral with the head portion of the housing, and the insulating tab may extend downwardly from the head portion. In yet another embodiment, the invention is directed to a one-piece, metallic element for a blade fuse. The blade fuse element has a fusible link and a pair of terminals. The fusible element extends above, rather than between, the terminals.

10 Claims, 2 Drawing Sheets

HIGH VOLTAGE AUTOMOTIVE USE

CROSS-REFERENCE TO RELATED APPLICATION

This application claims the benefit of U.S. Provisional Application No. 60/123,078, filed on Mar. 4, 1999.

DESCRIPTION

1. Technical Field

This invention relates generally to electrical blade fuses, and more particularly for blade fuses for use in higher voltage applications.

2. Background of the Invention

Electrical blade fuses are well-known in the art. The modem electrical blade fuse was perfected by Littelfuse, Inc., the assignee of the present invention, and was described in many patents by the assignee. These patents include but are not limited to, Littelfuse's U.S. Pat. Nos. 3,909,767; 4,023,265; 4,131,869; 4,580,124; 4,604,602; 4,635,023; 4,661,793; 4,997,393; 5,139,443; 5,663,861; and 5,668,521.

Some of fuses described in these patents include either a V-shaped or a sinusoidal-shaped fuse link. One example of such a V-shaped fuse link is that shown in U.S. Pat. No. 4,131,869. The V-shaped fuse link is shown as item 20 in FIG. 13 of the '869 patent, and is described at column 6, line 56, through column 7, line 18 of the '869 patent.

As is well-known in the art, blade fuses of the types shown in the above-referenced patents protect electrical circuits from current overloads. This protection results from the creation of a short in the fuse, and therefore in the circuit protected by the fuse, upon certain current or voltage overload conditions. Particularly, the fuse link breaks or opens upon current overload during a predetermined length of time.

Many of these blade fuses are extensively used in automobiles, and are therefore designed to be rated for service between 14 and 30 volts. Now, however, automobile manufacturers are designing more electrical accessories into automobiles, and are also designing or contemplating vehicles that use electrical motors, rather than internal combustion engines, for propulsion. Both of these developments increase the electrical demands upon current and future vehicles. As a result, circuits rated at up to 60 volts are now being contemplated for automobiles.

When the fusible link opens in fuses like those of the '869 patent, especially those rated at between 14 and 30 volts, an arc forms between the burnt ends of the fusible link. At these lower voltages, the arc will not cause serious damage to the metal and plastic portions of the fuse. At higher voltages, however, extensive damage to the metal and plastic portions of the fuse can occur.

SUMMARY OF THE INVENTION

The invention is a blade fuse having a housing section and a fusible element. The housing includes an insulating portion or tab extending from the housing section, and disposed between opposite ends of the fusible element.

One aspect of the invention is directed to a blade fuse where the insulating tab is integral with the housing. In another aspect of the invention, the insulating tab is integral with the head portion of the housing.

In yet another aspect of the invention, the insulating tab extends downwardly from the head portion.

Another aspect of the invention is a one-piece, metallic element for a blade fuse. The blade fuse element has a fusible link and a pair of terminals. The fusible element extends above, rather than between, the terminals. Preferably, the one-piece metallic element is constructed in a manner wherein the thickness of the fusible link is thinner than the thickness of the terminals.

There are two preferred ways that the fusible link may be made thinner than the terminals. The first is by a skiving process, and the second is by a coining process.

While the one-piece metallic element may be made of any suitable metal, a preferred metal for the metallic element is a zinc alloy. In any event, the metallic element must be of a character that it is suitable for use in a fuse having voltage ratings of up to sixty volts.

In a preferred embodiment of the invention, the one-piece metallic element has a fusible link whose height is greater than the height of the terminals.

Yet another embodiment of the invention is a fuse comprising the above-referenced one-piece metallic element, and further comprising a housing to enclose the metallic element. The housing includes an insulating tab extending from the housing. The tab is disposed between opposite ends of the fusible element. The insulating tab acts as an arc barrier.

DETAILED DESCRIPTION

This invention is susceptible of many different forms or embodiments. The drawings and the specification describe in detail a preferred embodiment of the invention. This disclosure is to be considered as one example of the principles of the invention. This disclosure is not intended to limit the broad aspect of the invention to the illustrated embodiment.

First Embodiment of the Invention

Figure 1:
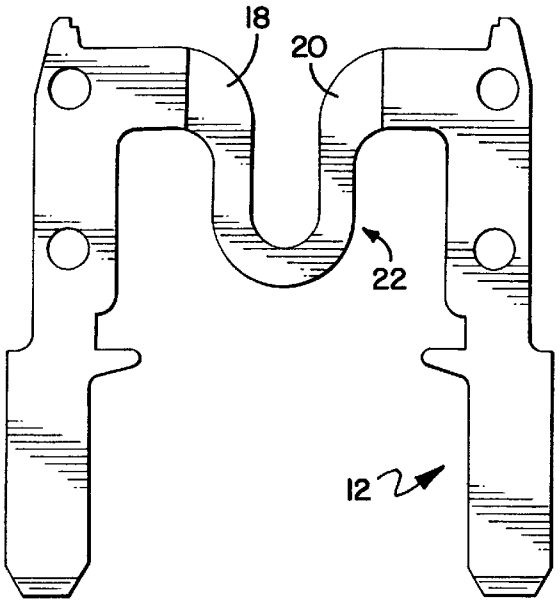
FIG. 1 is a perspective view of a one-piece, metal fusible link portion of one embodiment of a fuse in accordance with the invention.
Figure 2:
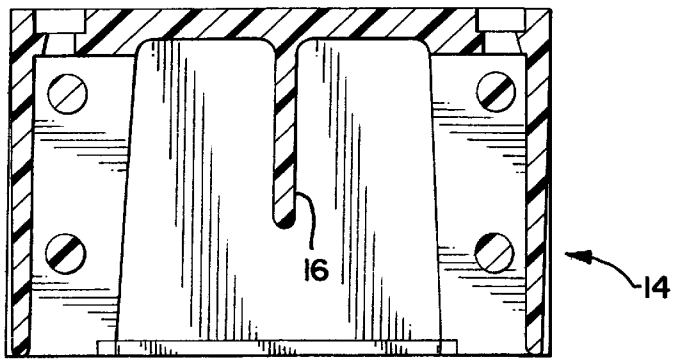
FIG. 2 is an enlarged perspective view of a fuse housing of one embodiment in accordance with the invention.
Figure 3:
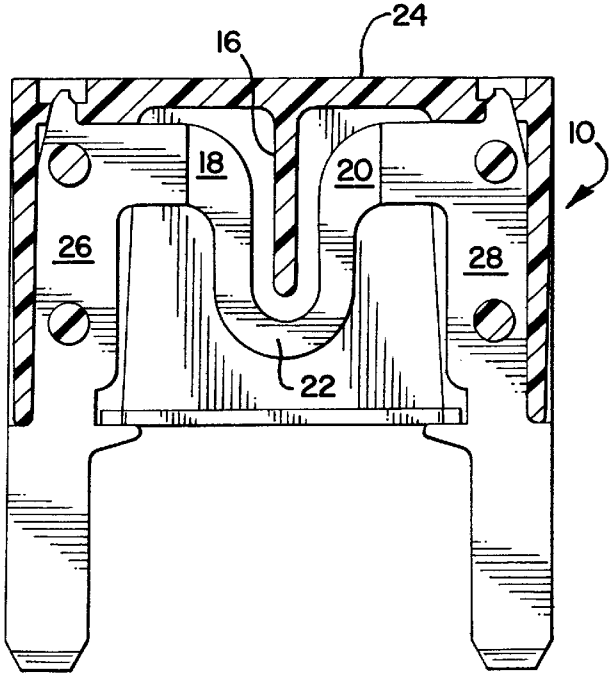
FIG. 3 is a frontal, partially sectional view of a preferred embodiment of a fuse in accordance with the invention, combining the fusible link portion of FIG. 1 with the fuse housing of FIG. 2.

The first embodiment of the invention is depicted in FIGS. 1–3. As may best be seen by a review of FIG. 3, the invention is a blade fuse 10. The blade fuse 10 of the preferred invention is of approximately the same dimensions as the MINI® fuse, manufactured by Littelfuse, Inc., the assignee of the present invention. In particular, the fuse has a height of approximately 0.659 inch, and a width of approximately 0.551 inch.

The fuse 10 is made of two major pieces, shown respectively in FIGS. 1 and 2. FIG. 1 shows the first of these major pieces, i.e., a one-piece blade fuse element 12. This blade fuse element 12 is preferably made of a metallic material, typically a coated zinc.

The second of these two major pieces, shown in FIG. 2, is a blade fuse housing 14. The blade fuse housing 14 is preferably made of thermoplastic. This housing 14 includes an insulating tab 16 that extends from the housing section 14. It is disposed between opposite ends 18 and 20 of the fusible element, i.e., the fusible link 22.

As is well-known in the art, this fusible link 22 is generally thinner than the remaining blade fuse element 12. The thinning of this fusible link 22 is effected by a skiving or similar process that is well known in the art. The extent of thinning of the fusible link 22 is generally directly proportional to the amperage rating of the blade fuse 10. Specifically, all other things being equal, the lower the amperage rating of the blade fuse 10, the thinner the fusible link 22.

In a most preferred embodiment, the insulating tab 16 is integral with the housing 14. Preferably, the tab 16 is integrated with the housing 14 by creating a suitable cavity for the tab 16 in the plastics injection mold used to make the housing 14. Most preferably, as may be seen in FIG. 3, the insulating tab 16 is integral with the head portion 24 of the housing 14, and extends downwardly from that head portion 24.

The blade fuse 10 of the invention has a number of advantages over prior art blade fuses.

First, the blade fuse 10 of the invention is designed to be used with forty-two or sixty (42- or 60-) volt, or even higher voltage circuits. Blade fuses used in such higher voltage circuits are more susceptible to arcing than the blade fuses found in 14- or 30-volt circuits typically found in contemporary automobiles. The tab 16 in the blade fuses 10 of the present invention acts as a physical barrier to any arc that may begin to form, preventing that arc from growing, and lowering its potential to cause excessive damage. The tab 16 also improves the interrupting capacity of the blade fuse 10.

Second, as may be seen in FIG. 3, the top portions of the opposite ends 18 and 20 of the fusible link 22 are preferably disposed very closely to the head portion 24 of the housing 14. This reduces the size of the potential path of any arc which could form near the top of these opposite ends 18 and 20, which in turn reduces the potential for arc formation.

Second Embodiment of the Invention

Another aspect of the invention includes a somewhat different, novel, one-piece, metallic element for a blade fuse. Like the embodiment of FIGS. 1–3, this metallic blade fuse element, which is shown in several different forms in FIGS. 4–8, has a fusible link and a pair of terminals.

Figure 4:
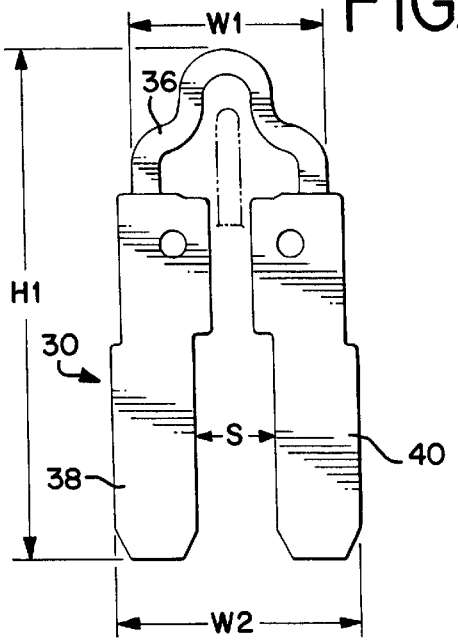
FIG. 4 is a perspective view of a one-piece, metallic element for a blade fuse in accordance with a second embodiment of the invention.
Figure 6:
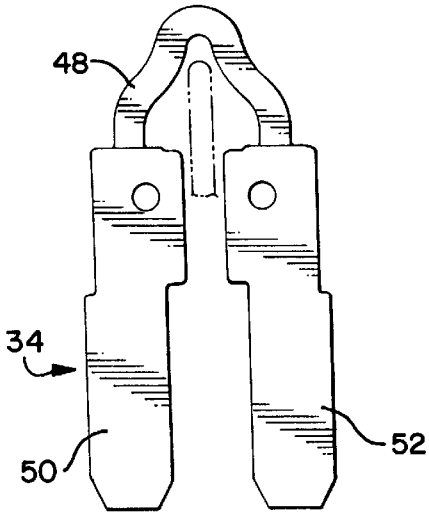
FIG. 6 is a perspective view of a one-piece, metallic element for a blade fuse in accordance with the second embodiment of the invention, but with a fusible link having a different shape than the fusible links of FIGS. 4 and 5.
Figure 5:
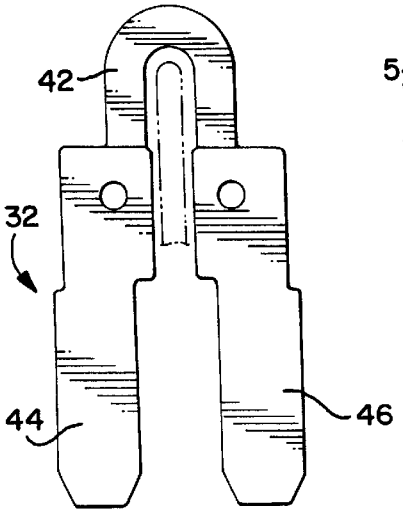
FIG. 5 is a perspective view of a one-piece, metallic element for a blade fuse in accordance with the second embodiment of the invention, but with a fusible link having a different shape than the fusible link of FIG. 4.

Most importantly, this second embodiment includes a fusible link extending above, rather than between, the terminals. For example, FIGS. 4, 5, and 6 depict one-piece metallic elements 30, 32, and 34, respectively, in accordance with the invention. As may be seen, for example, in FIG. 4, the fusible link 36 is positioned above its corresponding terminals 38 and 40. In FIG. 5, the fusible link 42 is positioned above its corresponding terminals 44 and 46 In FIG. 6, the fusible link 48 is positioned above its corresponding terminals 50 and 52. Each of these one-piece, metallic elements 30, 32, and 34 are substantially identical, except for the respective shapes of their fusible links 36, 42, and 48. Like the one-piece metallic elements of the first embodiment, the one-piece metallic elements of the second embodiment may be made of the same metallic material as the metallic elements of the assignee's prior blade fuses, typically a coated zinc. Again, these prior art blade fuses are described in many of the assignee's United States patents, including but not limited to U.S. Pat. Nos. 3,909,767; 4,023,365; 4,131,869; 4,580,124; 4,604,602; 4,635,023; 4,661,793; 4,997,393; 5,139,443; 5,663,861; and 5,668,521.

Placing the fusible element above the terminals has several distinct advantages. As may be appreciated by a review of FIGS. 4–6, and particularly FIG. 4, a fusible link 36 having the width W1 could not fit within the space S between terminals 38 and 40. It follows that removing the fusible link from between the terminals enables the designer of the one-piece metallic element to bring the terminals laterally closer to each other, resulting in a fuse that is compact along this dimension. Particularly, the width W2 of the one-piece metallic element 30 is less than the width of the prior art fuses. Accordingly, the resulting fuse will fit into a smaller "footprint" within a fuse block. As a result, a smaller, lighter fuse block (i.e., one having a smaller length and width) could be used for a given number of fuses.

Secondly, when the prior art fusible link is placed between the terminals, its length is generally shorter than the length of the terminals themselves. In contrast, in the present invention, placing the fusible link 36 above the terminals 38 and 40 removes this design constraint, and enables the fuse designer to make the fusible link 36 significantly longer.

As a result of the construction of FIG. 4, placing the fusible link 36 at the top of the terminals 38 and 40 creates a one-piece metallic element having a greater height H1 than those of prior art fuses. Fuses of the type which use these kinds of fusible elements are most typically blade fuses, and these blade fuses are most commonly used in the fuse boxes of automobiles. Automobile fuse boxes currently include relays and other electrical components that are generally much "taller" than existing, prior art blade fuses. In fact, even a blade fuse manufactured in accordance with the present invention, i.e., with its fusible element having a fusible link positioned above its terminals, will be "shorter" than these relays and other electrical components currently found in automobile fuse boxes. Thus, the new design described in this specification does not present the designer with insurmountable design constraints. Particularly. because of the height of the existing prior art fuse boxes, one-piece metallic elements 30 like that shown in FIG. 4 that have these "taller" profiles, and the "taller" fuses manufactured from these elements 30, will easily fit within the existing, prior art fuse boxes.

Figure 8:
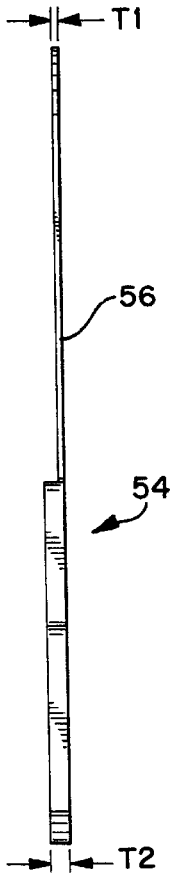
FIG. 8 is a side view of the metallic element of FIG. 7, taken along lines 8—8 of FIG. 7.
Figure 7:
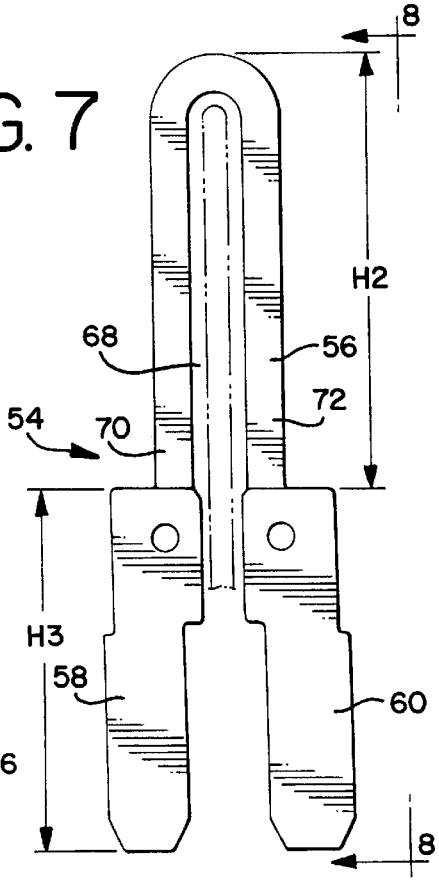
FIG. 7 is a perspective view of a one-piece, metallic element for a blade fuse in accordance with the second embodiment of the invention, but with a somewhat taller fusible link portion.

As with the terminals and fusible links of both the prior art and that of FIGS. 1–6, the terminals of the embodiment of FIGS. 7 and 8 are generally not of the same thickness. As may be seen in FIGS. 7 and 8, preferably, the one-piece metallic element 54 is constructed in a manner wherein the thickness T1 of the fusible link 56 is thinner than the thickness T2 of the terminals 58 and 60. It is known by those skilled in the art of fuse design that by varying the thickness T1 of the fusible link 56, one can design fuses having different amperage ratings.

There are two preferred ways that the fusible link 56 may be made thinner than the terminals 58 and 60. The first is by a skiving process, and the second is by a coining process. As noted above, these processes are well-known in the art of fuse manufacture. However, by placing the fusible link 56 above the terminals 58 and 60 rather than between the terminals, it is somewhat easier to skive or coin the fusible link 56. This is because there is a lesser need to do the skiving or coining work to avoid interference with the terminals 58 and 60.

As also indicated above, while the one-piece metallic elements of this embodiment may be made of any suitable metal, a preferred metal for the metallic element is a zinc alloy. In any event, the metallic element must be of a character that it is suitable for use in a fuse having voltage ratings of up to forty-two volts, and perhaps as high as sixty volts.

Referring again to FIGS. 7 and 8, in a preferred embodiment of the invention, the one-piece metallic element 54 has a fusible link 56 whose height H2 is greater than the height H3 of the terminals 58 and 60.

The one-piece metallic element of this second embodiment of FIGS. 4–8 may be combined with any suitable blade fuse housing (not shown), enclosing the one-piece metallic element to make a blade fuse. The blade fuse housing may be comprised of either one or two pieces.

This one or two-piece housing may also include an insulating tab like that shown in FIG. 3. The housing that would encase the metallic elements of FIGS. 4–8 would, however, be somewhat different from the housing 14 shown in FIG. 2. Particularly, the housing 14 of FIG. 2 is used for a fusible link 22 that opens upwardly. Accordingly, the insulating tab 16 of this housing 14 extends downwardly from the top wall of the housing 14.

In contrast, the fusible links 36, 42, and 48 of FIGS. 4, 5, and 6 open downwardly. The housing for the fusible links of FIGS. 4, 5, and 6 would preferably not extend downwardly from the top wall of their respective housings. Instead, for example, the insulating tab could extend from the side walls of those housings. Extending from the side walls of those housings (not shown), the insulating tab 68 is shown in phantom lines in FIGS. 4–7. That insulating tab 68 would be placed between the ends of the fusible links 36, 42, 48, as depicted in the phantom lines. In a one-piece housing, this insulating tab 68 would preferably extend from one of the two side walls of the housing, but it may extend from both of the two side walls of the housing. In a two-piece housing, this insulating tab 68 would preferably extend from only one of the two pieces of the housing, but may extend from both of the two pieces. In any event, the insulating tab 68 acts as an arc barrier.

While the specific embodiments have been illustrated and described, numerous modifications come to mind without significantly departing from the spirit of the invention. Thus, the scope of protection is to be limited only by the scope of the accompanying Claims.

We claim:

1. A metallic element for a blade fuse, said blade fuse element having a fusible link that ruptures upon a blown fuse causing event, said fusible link extending coplanar with and above, rather than between a plurality of substantially flat, male terminals attached to the fusible link, wherein the height of said fusible link is greater than the height of said terminals.

2. The one-piece metallic element of claim 1, wherein the thickness of the fusible link is thinner than the thickness of the terminals.

3. The one-piece metallic element of claim 2, wherein the fusible link is made thinner than the terminals by a skiving process.

4. The one-piece metallic element of claim 2, wherein the fusible link is made thinner than the terminals by a coining process.

5. A blade fuse having a housing and a fuse element, said fuse element including a fusible link having opposing legs, said element including a pair of terminal portions extending below said fusible link, said housing including an insulating tab attached to and extending from a head of said housing, said head located above said fusible link and said tab disposed between the opposite legs of said fusible link.

6. The one-piece metallic element of claim 1, wherein said metallic element is suitable for use in a fuse for voltages up to sixty volts.

7. A fuse, comprising the element of claim 1, and further comprising a housing to enclose said metallic element, said housing including an insulating tab extending from said housing, and disposed between opposite ends of said fusible link, said insulating tab acting as an arc barrier.

8. The fuse of claim 7, wherein said insulating tab is integral with said housing.

9. The fuse of claim 7, wherein said terminals extend parallel to at least a portion of a pair of legs of the fusible link.

10. The fuse of claim 7, wherein the terminals extend outside of the housing.

* * * * *

UNITED STATES PATENT AND TRADEMARK OFFICE

CERTIFICATE OF CORRECTION

PATENT NO. : 6,642,834 B1
DATED : November 4, 2003
INVENTOR(S) : Seibang Oh and James Jie Chen It is certified that error appears in the above-identified patent and that said Letters Patent is hereby corrected as shown below:

Title page,
Item [54], should read -- HIGH VOLTAGE AUTOMOTIVE FUSE --.

Signed and Sealed this

Thirtieth Day of March, 2004

JON W. DUDAS
*Acting Director of the United States Patent and Trademark Office*